US006450373B1

(12) United States Patent
Seltzer

(10) Patent No.: US 6,450,373 B1
(45) **Date of Patent: *Sep. 17, 2002**

(54) CONDIMENT PUMP

(75) Inventor: Eric Norton Seltzer, Reno, NV (US)

(73) Assignee: Carlisle FoodService Products, Incorporated, Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/932,909

(22) Filed: Aug. 20, 2001

Related U.S. Application Data

(63) Continuation of application No. 09/668,762, filed on Sep. 22, 2000, now Pat. No. 6,343,720.

(51) Int. Cl.[7] ..... B67D 5/40
(52) U.S. Cl. ..... 222/385
(58) Field of Search ..... 222/385, 382

(56) References Cited

U.S. PATENT DOCUMENTS

| | | | | |
|---|---|---|---|---|
| 1,307,478 A | | 6/1919 | Berdahl | |
| 2,811,284 A | | 10/1957 | Rogers | 222/173 |
| 2,837,246 A | | 6/1958 | Steele | 222/309 |
| 3,332,585 A | | 7/1967 | Cox | 222/309 |
| 4,917,525 A | | 4/1990 | Duncan | 403/27 |
| 5,375,746 A | | 12/1994 | Schaefer et al. | 222/385 |
| 5,381,932 A | | 1/1995 | Humphrey | 222/321 |
| 5,579,959 A | | 12/1996 | Bennett et al. | 222/385 |
| 6,019,256 A | | 2/2000 | Seltzer | 222/385 |
| 6,343,720 B1 | * | 2/2002 | Seltzer | 222/385 |

* cited by examiner

*Primary Examiner*—Philippe Derakshani
(74) *Attorney, Agent, or Firm*—McAfee & Taft

(57) ABSTRACT

A piston displacement condiment pump for pumping viscous fluids, especially condiments such as ketchup, mustard, mayonnaise, relish, sauces and the like, is disclosed. The pump is constructed mostly of stainless steel and includes an inflow chamber with a check ball valve, an outflow chamber with a another check ball valve, and a spout. The pump includes an optional method for limiting the amount of condiment delivered with each stroke of the pump. The spout is held in place with a unique pin and L-slot arrangement, and by the unique position of the outflow chamber in relation to the cover. The spring and inflow check ball is attached to the piston and the outflow check ball is attached to the spring wire clip. The novel spring wire clip restrains the check ball valve in the outflow chamber.

19 Claims, 7 Drawing Sheets

CONDIMENT PUMP

CROSS REFERENCE TO RELATED APPLICATIONS

This application is a continuation of co-pending application Ser. No. 09/668,762, filed on Sep. 22, 2000, now U.S. Pat. No. 6,343,720 which issued Feb. 5, 2002.

| U.S. PATENT DOCUMENTS | | |
|---|---|---|
| 1,307,478 | 6/1919 Berdahl | |
| 2,811,284 | 10/1957 Rogers | 222/173 |
| 2,837,246 | 6/1958 Steele | 222/309 |
| 3,332,585 | 7/1967 Cox | 222/309 |
| 4,917,525 | 4/1990 Duncan | 403/27 |
| 5,375,746 | 12/1994 Schaefer et al | 222/385 |
| 5,381,932 | 1/1995 Humphrey | 222/321 |
| 5,579,959 | 12/1996 Bennett et al | 222/385 |
| 6,019,256 | 2/2000 Seltzer | 222/321 |
| FOREIGN PATENT DOCUMENTS | | |
| 516855 | 1/1940 United Kingdom | |

STATEMENT REGARDING FED SPONSORED R&D

N/A

REFERENCE TO SEQUENCE LISTING

N/A

BACKGROUND OF THE INVENTION

A. Field of the Invention

This invention relates generally to pumps for viscous fluids. Specifically, the invention is a hand pump for use with condiments such as flavored syrups, ketchup, mustard, mayonnaise, relish and similar products.

B. Description of Related Art

Nearly all retail stores which sell ready to eat food have some type of system for allowing the customer to apply various condiments (e.g. ketchup, mustard, relish, flavored syrup, etc.) To the food. And while there are various approaches to the problem of storing and dispensing condiments, one popular approach is to use a stainless steel tub and hand pump.

In general, the prior art consists of a piston displacement pump, an inlet chamber with a check valve, an outlet chamber with a check valve, and a dispensing spout. The combination of a piston displacement pump with two chambers and check valves predates their use in food dispensing. For example, Berdahl used this arrangement in an oil can. U.S. Pat. No. 1,307,478, granted Jun. 24, 1919. Turning to food dispensing, Cox used the same basic elements in an adjustable syrup pump, U.S. Pat. No. 3,332,585, as did Bennett et al. In U.S. Pat. No. 5,579,959. Two recent, popular food pumps, using this same approach, are Schaefer et al., U.S. Pat. No. 5,375,746, and Humphrey, U.S. Pat. No. 5,381,932. The most recent food pump by Seltzer (same inventor as this application), U.S. Pat. No. 6,019,256, also uses the same approach.

A review of the prior art patents, particularly the discussion in Schaefer et al, Humphrey, and Bennett et al., shows that there has been an ongoing sense of frustration with the prior art pumps on the following grounds: they are too complicated to manufacture; they have too many parts; they are prone to clogging; they are difficult to clean; and when disassembled for cleaning there are small parts that fall out and can get lost.

Accordingly, there is a need for a condiment pump which is easy to manufacture, has a minimum of parts, resists clogging, is easy to clean without small parts that can fall out and get lost.

BRIEF SUMMARY OF THE INVENTION

A condiment pump meeting the foregoing needs is disclosed. The condiment pump has a pump means in the form of a standard piston displacement pump. The standard piston displacement pump is well known in the art and is comprised of a cylinder, a rod with a piston at the bottom of the rod inside the cylinder which is biased, usually by a spring, in an upward position, and a seal attached to the piston which makes a tight but slidable fit with the interior wall of the cylinder. In the instant invention, the rod is optionally fitted with limiting means for limiting the travel of the rod. By limiting the travel of the rod within the cylinder, the condiment pump can be made to deliver a reduced and measured volume of condiment. The instant invention also has a means for attaching the check ball to the bottom of the spring, and for attaching the spring to the bottom of the piston so that these parts stay attached when the piston is removed from the cylinder for cleaning.

The pump means has inflow means formed at the lower end of the pump means. The inflow means has an interior inflow chamber with a first valve means inside the interior chamber. The valve means is most conveniently made from a special check ball valve, although other types of check valves, such as flap valves are also possible. The inflow chamber has three openings: a top opening which communicates with the pump means; a bottom opening which communicates with the supply of condiment to be pumped; and a side opening which communicates with an outflow means. The inflow chamber is designed so as to prevent the spring from blocking the side opening.

The outflow chamber communicates with the side opening of the interior chamber of the inflow means using a piece of elbow tubing. The outflow means has an interior chamber with a top opening and a bottom opening, and a second valve means inside the outflow chamber. The elbow tubing has a lower end which communicates with the side opening of the inflow chamber and an upper end which communicates with the lower opening of the outflow chamber.

There is also a spout having an upper end and a lower end where the lower end is equipped with a spout adapter. The spout adapter is disposed inside the upper opening of the outflow chamber. The spout adapter has a pin which engages a L-slot pin receiving means in the upper end of the outflow means. The pin and pin receiving means prevent the spout from rotating, or moving axially relative to the outflow means. The spout adapter detachably engages a spring wire clip which holds the check valve and also prevents the valve means, typically a check ball valve, from plugging the lower end of the spout.

The spout and the pump means both protrude through a cover with two orifices. a pump orifice and a spout orifice. The pump means includes a screw-on cap which is larger than the pump orifice, thus holding the cover tightly in place. The cover, in turn, then holds the spout adapter firmly within the upper end of the outflow chamber.

It is an object of the invention to produce a condiment pump which has a minimum of moving parts.

It is an object of the invention to produce a condiment pump which is easy to assemble and disassemble without using any tools.

It is an object of the invention to produce a condiment pump which is easy to clean.

It is an object of the invention to produce a condiment pump which can be disassembled without any loose parts that can fall out and get lost.

It is an object of the invention to produce a condiment pump which is inexpensive to manufacture.

It is an object of the invention to produce a condiment pump which resists clogging.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the claims.

DETAILED DESCRIPTION

The condiment pump has five assemblies: a pump means, 100; an inflow means, 200; an outflow means, 300; a spout assembly, 400; and a lid assembly, 500. The overall arrangement of these assemblies may be seen in FIG. 1 and FIG. 4.

Figures 1, 2, 3:
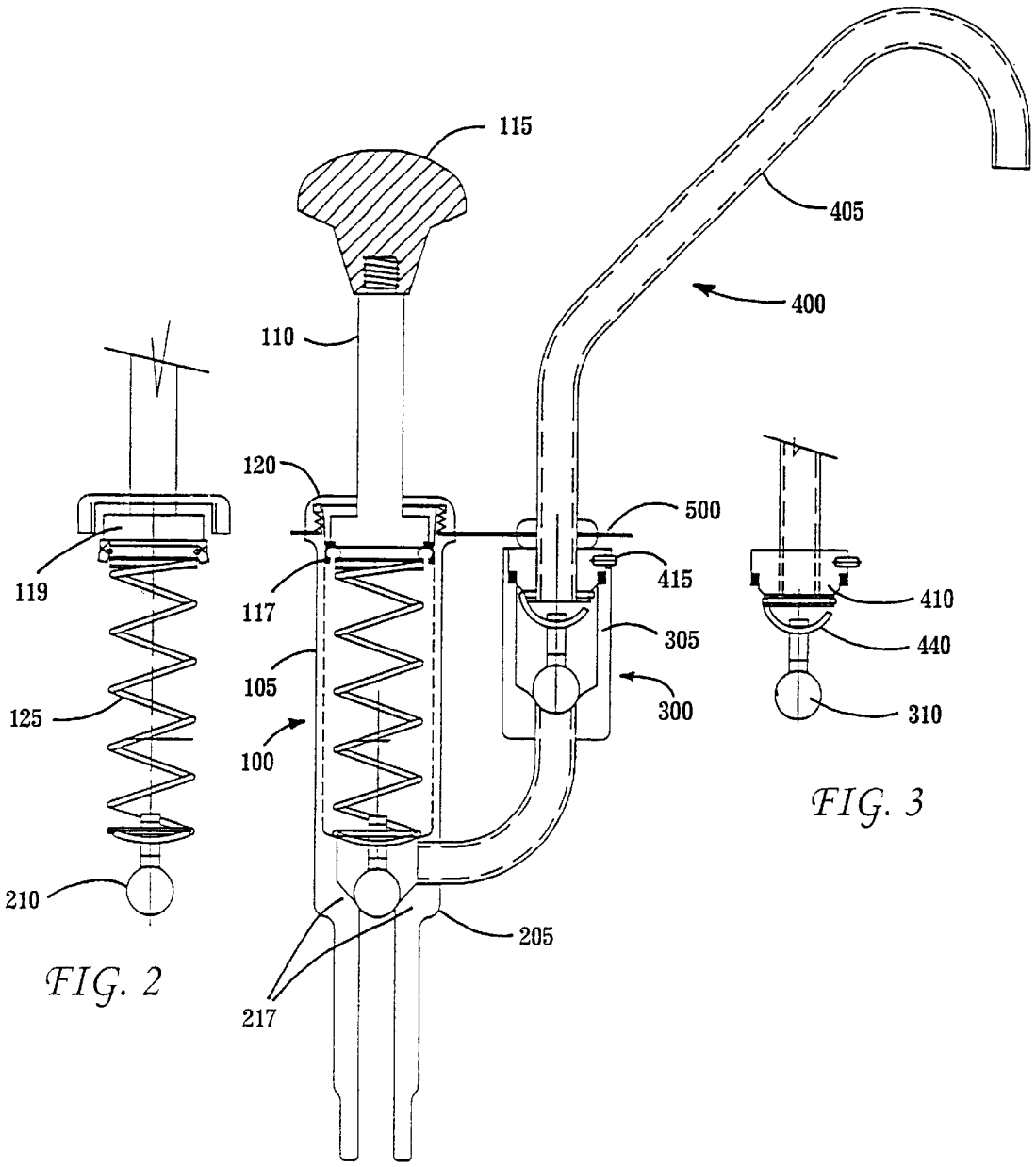
FIG. 1 is a cutaway view of the invention
FIG. 2 is a cutaway view of the piston/spring/check ball assembly.
FIG. 3 is a cutaway view of the spout adaptor/spout clip/check ball assembly
Figure 12:
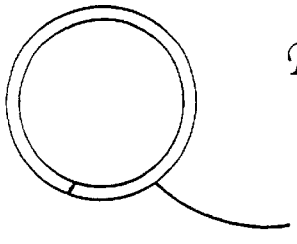
FIG. 12 is a top plan view of the spring

The pump means, 100, is comprised of a cylinder, 105, which has a rod, 110, disposed within it, and a spring, 125, which biases the rod, 110, in an upward position. The rod, 110, has a detachable knob, 115, at its upper end, and a piston seal, 117, at its lower end. In FIG. 4 we see a plastic cylinder detachable limiting means, 130, to be spread open and placed around the rod, 110. The limiting means, 130, limits the distance the rod, 110, can travel vertically and thus restricts the volume of condiment which is dispensed with each stroke of the rod, 110. The rod, 110, and piston, 119, are held within the cylinder, 105, by a screw-on cap, 120. The screw-on cap, 120, also holds the lid assembly, 500, against a ledge, 135, which is machined into the top of the cylinder, 105. FIG. 2 shows how the spring, 125, attaches to the piston, 119, and how the first check ball, 210, attaches to the bottom of the spring, 125. (See also FIG. 12, 13, & 14 for details of the spring, 125.)

Figure 5A:
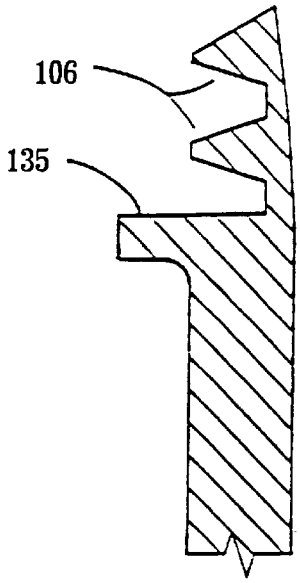
FIG. 5*a* is a cutaway view of a detail of the cylinder
Figure 5:
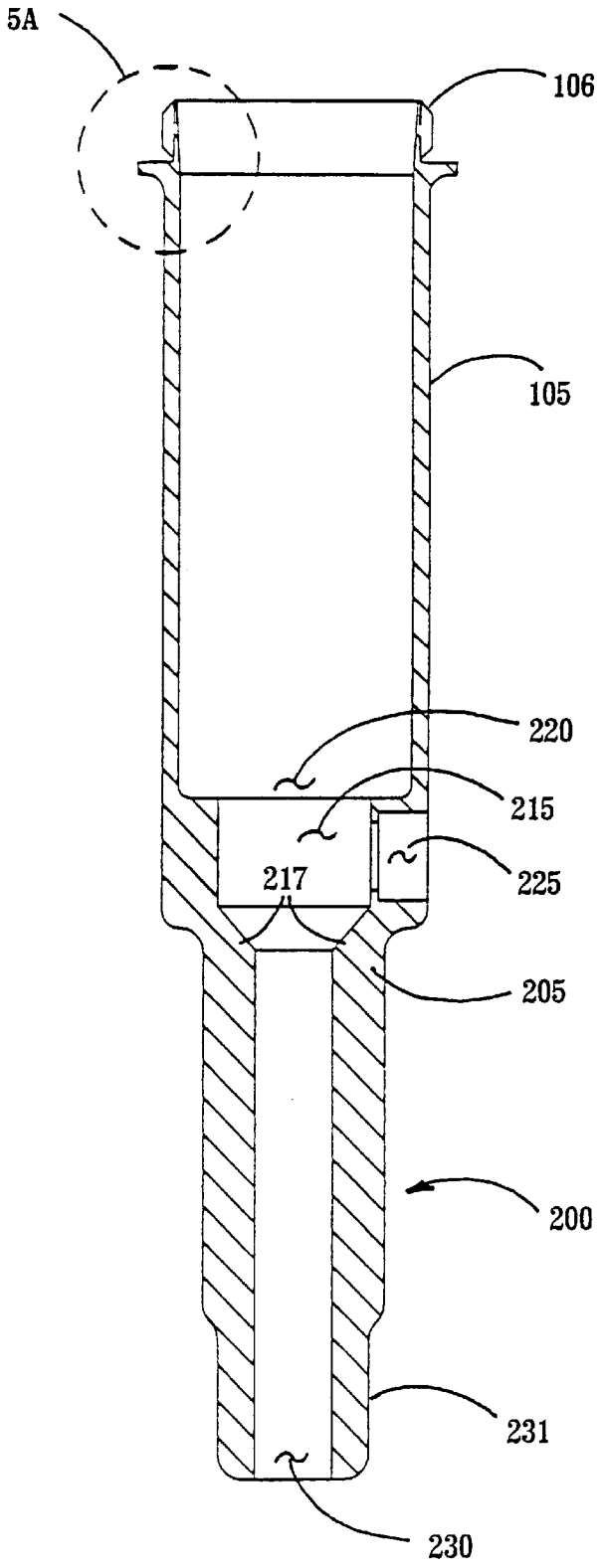
FIG. 5 is a cutaway view of the piston cylinder/inflow means

In FIG. 5 we see a more detailed view of the cylinder, 105. The cylinder, 105, has male threads, 106, at its top end, and the inflow means, 200, at its bottom end.

In FIG. 5 we also see a detailed view of the inflow means, 200. The inflow means, 200, is comprised of an inflow body, 205, which has an inflow chamber, 215, with a first valve means comprised of a first check ball, 210, and a first annular seat, 217, inside the inflow chamber, 215 (the first check ball, 210, is removed from FIG. 5 for clarity but is visible in FIG. 1 to FIG. 4). This check ball, 210, is a unique design with a slot, 211, for attaching the check ball to the spring, 125. The second check ball, 310, is identical to the first check ball, 210, and also has a slot, 311, for attaching to the spout clip, 440.

Figure 14:
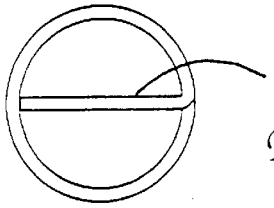
FIG. 14 is a bottom plan view of the spring

The inflow chamber, 215, has a top opening, 220, a side opening, 225, and a bottom opening, 230. The top opening, 220, and the bottom opening, 230, are parallel to each other with a mutual center line, and the side opening, 225, has a center line which is perpendicular to the center line of the top and bottom openings, 220,230. The bottom of the inflow body, 231, is sized to make a pressure fit with a piece of plastic tubing, 235 (visible in FIG. 4) which comes in different lengths as needed for various condiment containers. The top opening, 220, is sized so as to keep the spring, 125, from entering the inflow chamber, 215. The spring, 125, has a closed end, 127, at the bottom, see FIG. 14, which holds the first check ball, 210, in place and prevents it from entering the cylinder.

The first annular seat, 217, is disposed between the inflow chamber, 215, and the bottom opening, 230. The first annular seat, 217, is sized to be smaller in diameter than the first check ball, 210, and cut at an angle (an angle of approximately eighty-two degrees is ideal) so as to make a good seal with the first ball, 210. When the condiment pump is full of fluid and the rod, 110, is pushed down against the spring, 125, the fluid in the cylinder, 105, and inflow chamber, 215, flow down against the first check ball, 210, pushing the first check ball, 210, against the annular seat, 217, forming a seal which prevents fluid from flowing through the bottom opening, 230, thereby forcing fluid through the side opening, 225.

Figure 6:
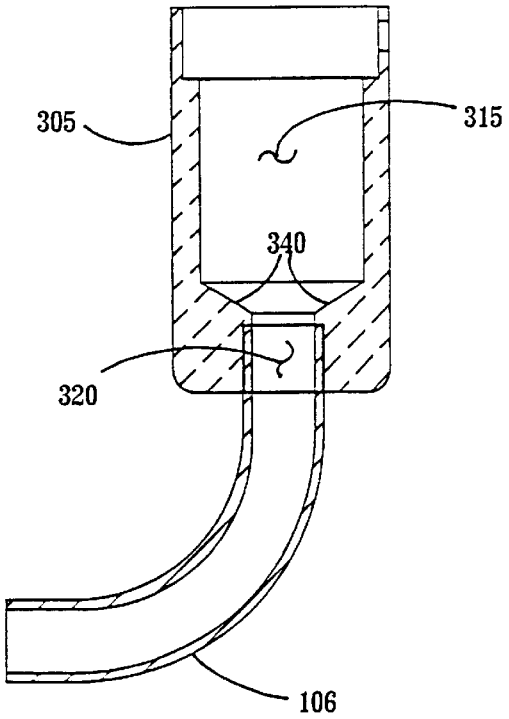
FIG. 6 is a cutaway view of the elbow/outflow means
Figure 7:
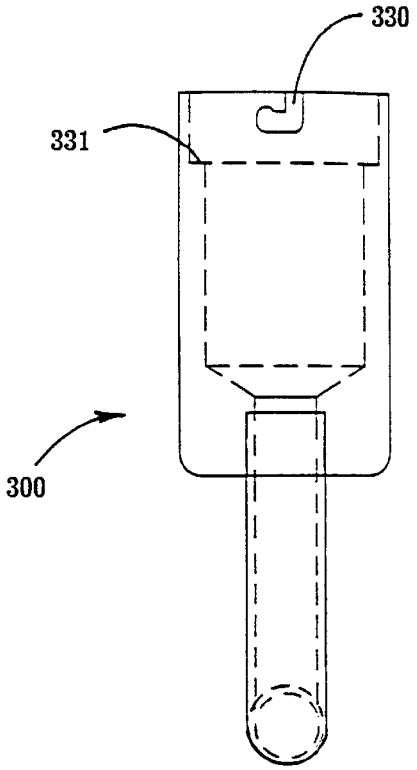
FIG. 7 is a transparent view of the elbow/outflow means
Figure 8:
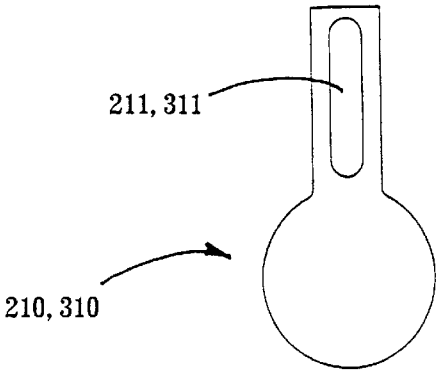
FIG. 8 is an elevation of the check ball
Figure 9:
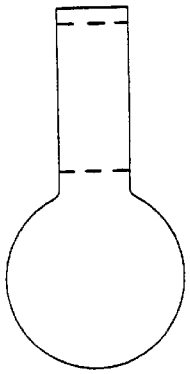
FIG. 9 is a transparent view of the check ball

FIG. 6 and FIG. 7 show the outflow means, 300, with an outflow body, 305, having an outflow chamber, 315, where the outflow chamber, 315, has a second valve means comprised of a second check ball, 310 (not shown for clarity but visible in FIG. 1 and FIG. 4), and a second annular seat, 340. At its upper end, the outflow body, 305, has a L-slot pin receiving means, 330, for receiving a pin. At its lower end, the outflow body, 305, has an annular seat, 340, which necks down to a lower orifice, 320, which receives the upper end of a piece of elbow tubing, 325. The elbow tubing is bent at an angle of approximately ninety degrees and is oriented so that the lower end of the elbow tubing, 325, is pointed at an angle of one hundred and eighty degrees relative to the position of the L-slot pin receiving means, 330. In this way, when the lower end of the elbow tubing, 325, is inserted into the side hole, 225, of the inflow body, 205, the L-slot pin receiving means, 330, will point directly away from the pump means, 100. On each end, the elbow tubing, 325, is sized for a pressure fit, although better results are obtained by welding the elbow tubing, 325, in place, plus the weld fillet is more sanitary than a pressure fit only. There is a ledge, 331, in the outflow body, 305, that provides a stop for the o-ring, 435, see FIG. 4, so that when the spout assembly, 400, is inserted into the outflow body, 305, the pin, 415, stays engaged it in the L-slot, 330, with upward pressure from the o-ring, 435, compressed against the ledge, 331.

Figure 10:
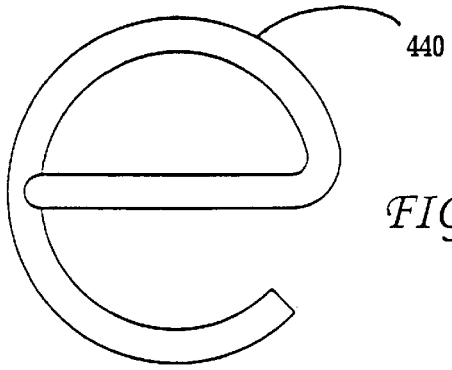
FIG. 10 is a plan view of the spring wire clip
Figure 11:
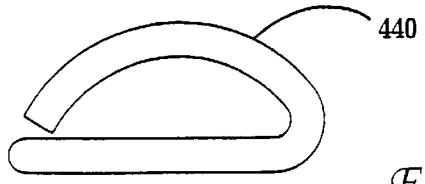
FIG. 11 is an elevation view of the spring wire clip

Looking at FIGS. 10 & 11, we see two views of the spring wire clip, 440. The spring wire clip makes an arc of approximately three hundred and fifteen degrees in a first plane and then forms an arc of approximately one hundred and seventy degrees in a second plane where the first plane and second plane are perpendicular.

Figure 15:
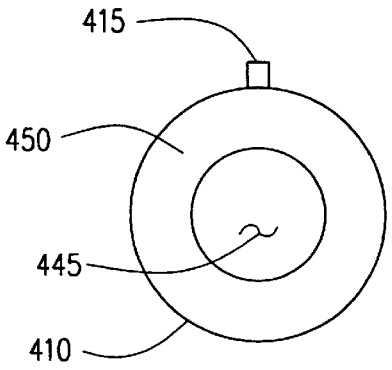
FIG. 15 is a plan view of the spout adapter
Figure 16:
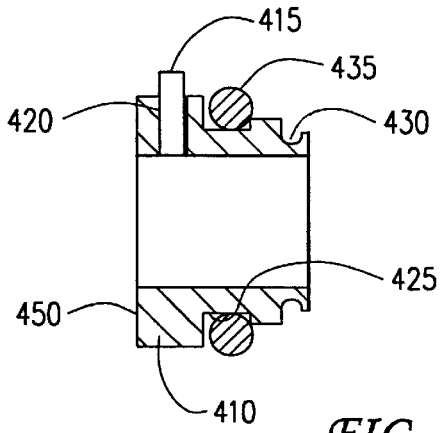
FIG. 16 is a cutaway view of the spout adapter
Figure 17:
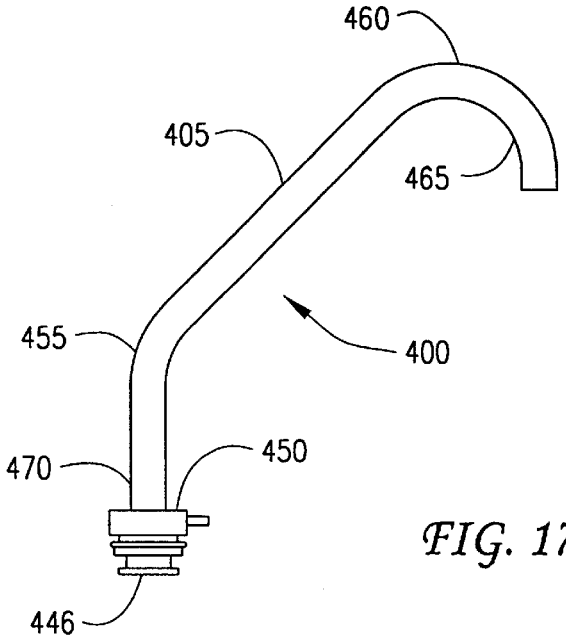
FIG. 17 is an elevation view of the spout with the spout adapter
Figure 18:
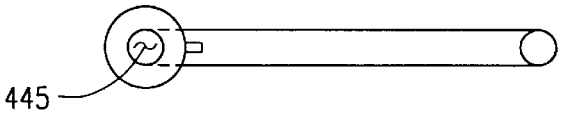
FIG. 18 is a bottom plan view of the spout with the spout adapter

The spout assembly, 400, is shown in FIGS. 15–18. FIGS. 17–18 show the completed spout assembly, 400, while FIGS. 15–16 show the spout adapter, 410, in detail. The spout, 405, has a lower end, 470, and a terminal end, 465. The spout, 405, has two curves, 455, 460, which, together change the direction of the spout by approximately one hundred and eighty degrees from the lower end, 470, to the terminal end, 465. The lower end, 470, is fitted with a spout adapter, 410, preferably by means of a pressure fit with a weld. The spout adapter has an upper surface, 450, and a lower surface, 446. The lower surface, 446, is machined to slightly reduce its overall diameter and to produce two slots, 425, 430. The upper slot, 425 (FIG. 16 is shown sideways in the informal drawings), receives an o-ring, 435, while the lower slot, 430, detachably engages the spring wire clip, 440. The lower end, 470, is pressed into a hole, 445, in the spout adapter, 410, and may be welded in place. The spout adapter, 410, has a pin hole, 420, which engages the pin, 415.

The spout, 405, is oriented in the spout adapter, 410, so that the pin, 415, points toward the terminal end, 465, of the spout, 405. Accordingly, when the spout assembly, 400, is inserted and rotated into the L-slot of the L-slot pin receiving means, 330, the terminal end, 465, of the spout, 405, will point directly away from the pump means, 100.

Figure 13:
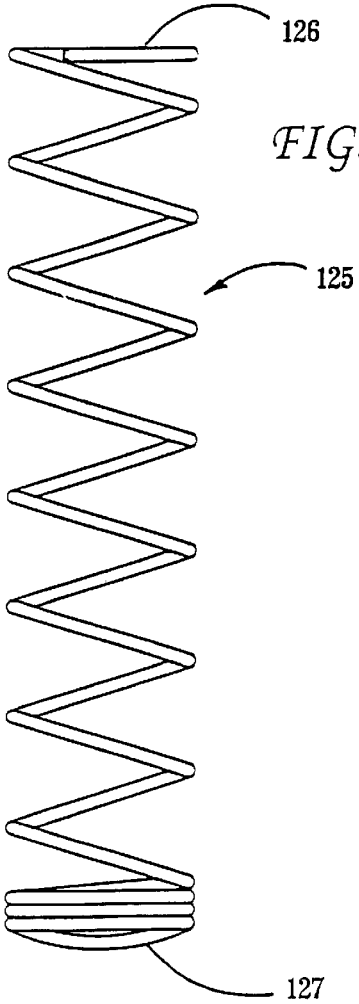
FIG. 13 is an elevation view of the spring
Figure 19:
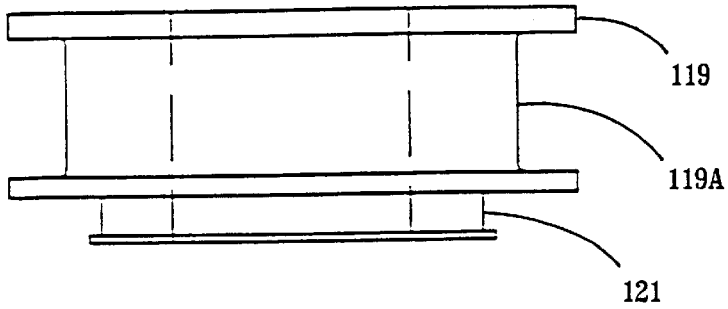
FIG. 19 is an elevation view of the piston
Figure 19A:
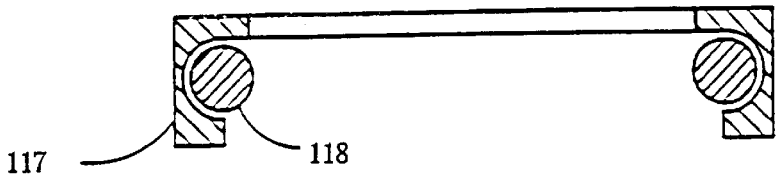
FIG. 19A is a cutaway view of the piston seal and o-ring
Figure 20:
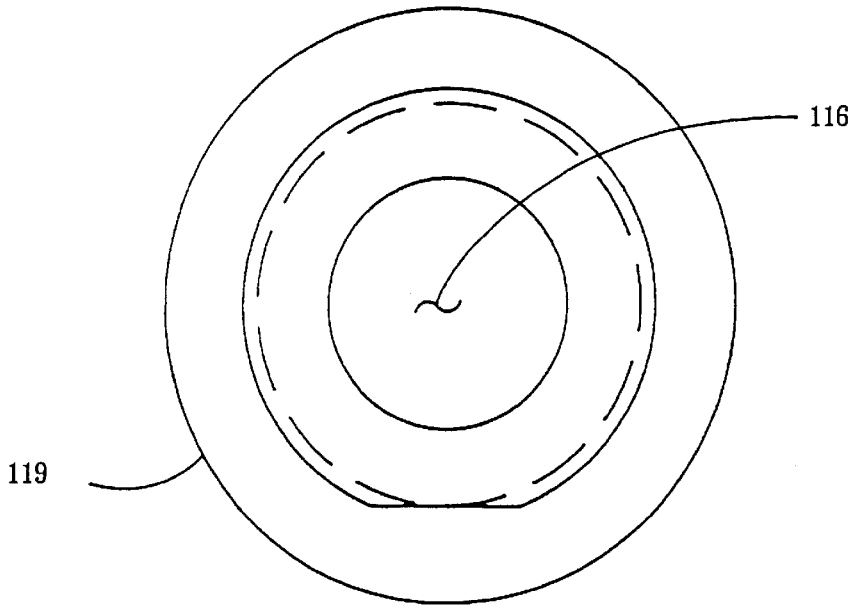
FIG. 20 is a bottom plan view of the piston

In FIGS. 19, 19A, and 20, we see detailed drawings of the piston seal, 117, with o-ring, 118, and piston, 119. The piston, 119, has a rod hole, 116, into which the lower end of the rod, 110, is inserted and held in place with a pressure fit and/or a weld. The piston should be oriented so that the second o-ring groove, 119A, is disposed toward the bottom of the cylinder, 105, and away from the knob, 115. The piston seal, 117, with its second o-ring, 1187, are then placed over the piston, 119, so that the second o-ring, 118, fits into the second o-ring groove, 119A. The piston, 119, also has a groove, 121, to hold the upper end, 126, of the spring 125, see FIGS. 12 and 13.

Figure 4A:
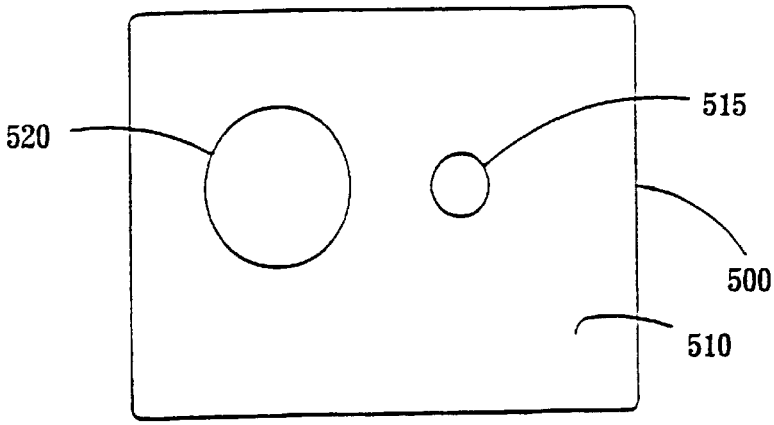
FIG. 4A is a plan view of the cover assembly
Figure 4:
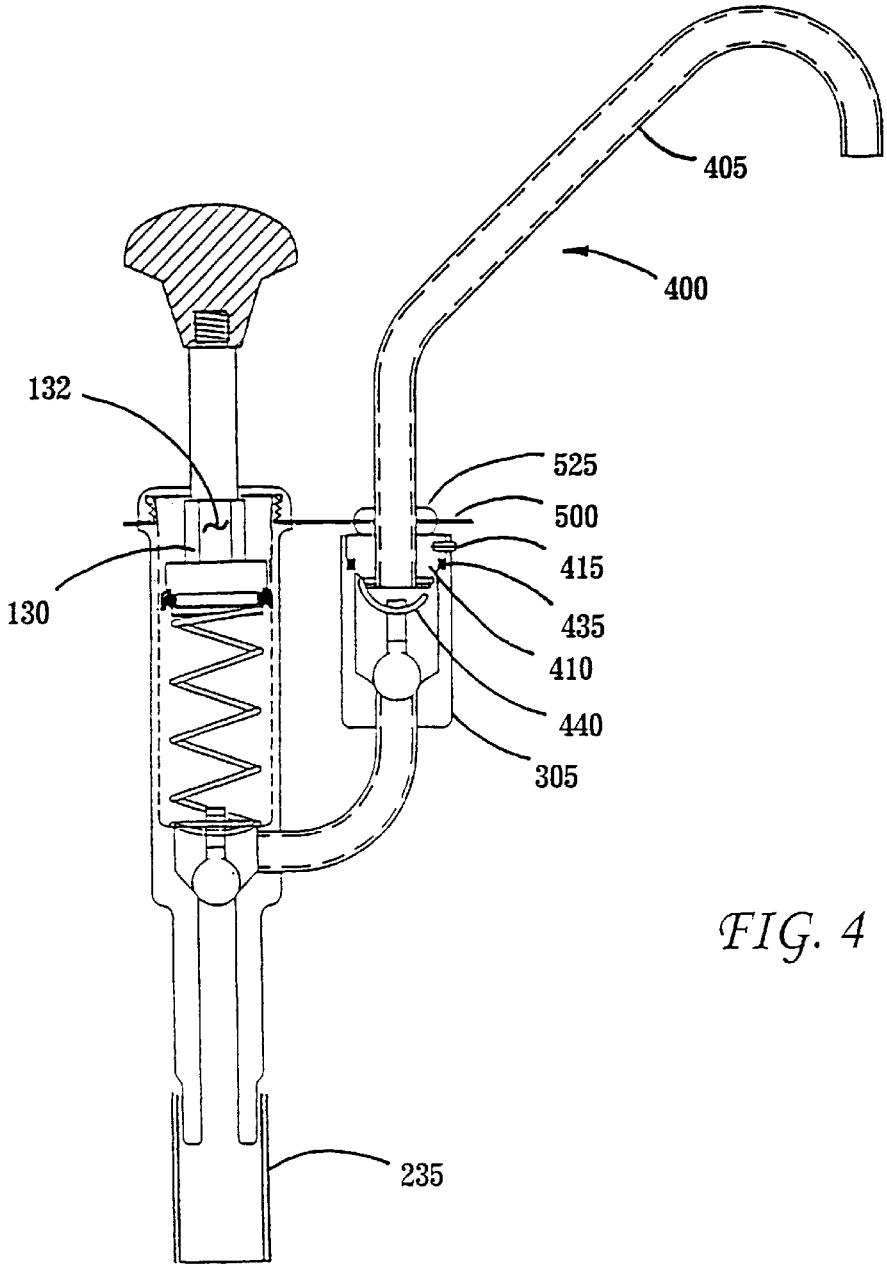
FIG. 4 is a cutaway view of the invention

The cover assembly, 500, is visible in FIG. 4 and FIG. 4A. The cover assembly is comprised of a cover plate, 510, with a spout orifice, 515, and a pump orifice, 520. The spout orifice is fitted with a rubber grommet, 595. To place the cover assembly, 500, on the condiment pump, the user would first unscrew the threaded cap, 120, and revolve the rod, 110. The user would then insert the spout, 405, through the spout orifice, 515, terminal end, 465, first, until the cover was positioned so that the pump orifice, 520, was resting on the ledge, 135. The user would then place the rod, 110, back into the cylinder, 105, and then screw on the threaded cap, 120. The pump orifice, 520, is sized so that it is larger than the cylinder, 105, but smaller than either the ledge, 135, or the threaded cap, 120. Accordingly, the ledge, 135, and threaded cap, 120, hold the cover plate, 510, in place. The cover plate, 510, in turn holds the spout assembly, 400, in place, thus eliminating the need for the spout to be firmly attached to the cover itself.

The invention is used by placing the cover assembly, 500, with the pump attached as described above, orver a condiment container or tub (usually made of stainless steel) which has an open top suitable for detachably engaging the cover assembly, 500. The bottom of the pump is thus immersed in the condiment which allows the user to pump condiment by operating the pump.

All parts of the invention are stainless steel, with the following exceptions: the knob, 115, made of plastic; the grommet, 525, and o-rings, 435, and 118, made of rubber; and the piston seal, 117, and optional tube, 235, made of plastic.

Each of the elements described above, or two or more together, may also find a useful application in other types of methods differing from the type described above. While certain novel features of this invention have been shown and described and are pointed out in the annexed claims, it is not intended to be limited to the details above, because various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A pump for pumping viscous fluids from a container containing said viscous fluids, the pump comprising:

a cylinder;

a piston slidably disposed in said cylinder;

a piston rod connected to and extending upwardly from said piston;

an inflow body having an upper end and a lower end, the inflow body defining an inflow chamber communicated with said cylinder;

a first ball valve disposed in said inflow body, said ball valve comprising;

a first ball seat defined in said inflow body; and a first ball for engaging said first ball seat and allowing flow in only one direction;

a cylinder spring disposed in said cylinder for biasing said piston upwardly in said cylinder, said cylinder spring having an upper and a lower end, the lower end of said cylinder spring being detachably connected to said first ball;

a connecting tube communicated at a first end with said inflow chamber and at a second end to an outflow body, the outflow body having a second ball valve therein, the second ball valve comprising a second ball seat defined by said outflow body and a second ball for engaging said second ball seat and allowing flow only in one direction; and a spout communicated with said outflow body for receiving said viscous substance therefrom.

2. The pump of claim 1, further comprising biasing means in said outflow body for biasing said second ball away from a spout opening through which said viscous substance is communicated to said spout, so that said second ball will not block said spout opening.

3. The pump of claim 2, wherein said biasing means comprises a spring.

4. The pump of claim 3, wherein said spring in said outflow body is detachably connected to said second ball.

5. The pump of claim 1, said first ball comprising a generally spherical ball having an arm extending therefrom, the arm having a slot therethrough for connecting to said lower end of said cylinder spring.

6. The pump of claim 5, the second ball being generally identical to the first ball, said second ball being detachably connected to a spring in said outflow body for biasing said second ball away from a spout opening through which said viscous substance is communicated into said spout.

7. The pump of claim 1, wherein said first end of said cylinder spring is attached to said piston.

8. A pump for pumping viscous fluid from a container, the pump comprising:

a cylinder;

a piston slidably disposed in said cylinder;

a piston rod connected to said piston;

an inflow body defining an inflow interior at a lower end of said cylinder;

a first ball valve operably associated with said inflow body for allowing flow through said inflow body from said container into said cylinder and for preventing flow in the opposite direction;

an outflow body communicated with said inflow body with a connecting tube;

a spout communicated with said outflow body for receiving said viscous fluid therefrom;

a second ball valve operably associated with said outflow body for allowing flow from said connecting tube into said outflow body and for preventing flow in the opposite direction, the second ball valve comprising;

a second ball seat; and a second closing ball for engaging said second ball seat; and a spring detachably connected to said second ball for biasing said second ball away from a spout opening through which said viscous fluid passes from said outflow body into said spout.

9. The pump of claim 8, further comprising a spring disposed in said cylinder for biasing said piston upwardly therein.

10. The pump of claim 9 wherein said first ball valve comprises:

a first ball seat; and a first ball for engaging said first ball seat, wherein said spring disposed in said cylinder is detachably connected to said first ball.

11. The pump of claim 8, wherein said second ball comprises a generally spherical ball having an arm extending therefrom, the spring in said outflow body being connected to said arm.

12. The pump of claim 11, said first and second balls being identical to one another.

13. The pump of claim 8 further comprising a spout adapter connected to a lower end of said spout, said spout adapter including a retaining pin, wherein said outflow body defines a retaining slot for receiving said retaining pin to connect said spout adapter to said outflow body.

14. The pump of claim 13 wherein said pin limits the vertical movement of said spout relative to said outflow body.

15. A pump for pumping viscous fluids from a container, the pump comprising:

a cylinder having an upper end and a lower end, the lower end being adapted to be communicated with said container so that said viscous fluids may be received therefrom into said cylinder;

a piston slidably disposed in said cylinder;

a ball valve operably associated with said cylinder, wherein said ball valve allows flow into said cylinder from said container and prevents flow from said cylinder into said container;

an outflow body;

a connecting tube for communicating said viscous fluid from said cylinder to said outflow body;

a second ball valve operably associated with said outflow body, wherein said second ball valve prevents flow from said outflow body into said connecting tube and allows flow from said connecting tube into said outflow body, the second ball valve comprising:

a ball seat; and a ball for engaging said ball seat;

a spout for receiving said viscous fluid from said outflow body, said spout having a first end for receiving said viscous fluid and a second end through which said viscous fluid may be expelled; and a spring for biasing said second ball away from said first end of said spout, said spring being detachably connected to said second ball.

16. The pump of claim 15, further comprising a spout adapter connected to said first end of said spout for connecting said spout to said outflow body.

17. The pump of claim 16, said spring also being connected to said spout adapter.

18. The pump of claim 15, said first ball valve comprising a first ball seat and a first ball for engaging said first ball seat.

19. The pump of claim 18, further comprising a cylinder spring disposed in said cylinder, said cylinder spring being detachably connected to said first ball.

* * * * *